US007013528B2

(12) United States Patent
Parker et al.

(10) Patent No.: US 7,013,528 B2
(45) Date of Patent: Mar. 21, 2006

(54) FLOOR CLEANER WITH DUSTING

(75) Inventors: Timothy S. Parker, Rockford, MI (US); David L. Haan, Wyoming, MI (US); David E. McDowell, Grand Rapids, MI (US)

(73) Assignee: Bissell Homecare, Inc., Grand Rapids, MI (US)

( * ) Notice: Subject to any disclaimer, the term of this patent is extended or adjusted under 35 U.S.C. 154(b) by 358 days.

(21) Appl. No.: 10/248,101

(22) Filed: Dec. 18, 2002

(65) Prior Publication Data

US 2004/0045126 A1 Mar. 11, 2004

Related U.S. Application Data

(60) Provisional application No. 60/352,350, filed on Jan. 28, 2002, provisional application No. 60/319,594, filed on Oct. 3, 2002.

(51) Int. Cl.
*A47L 9/06* (2006.01)

(52) U.S. Cl. ..... 15/403; 15/364; 15/4; 15/52.1; 15/98

(58) Field of Classification Search ..... 15/403, 15/383, 364, 380, 41.1, 43–44, 51, 98–99, 15/4, 48.1, 49.1, 50.3, 52, 52.1
See application file for complete search history.

(56) References Cited

U.S. PATENT DOCUMENTS

| | | | | | |
|---|---|---|---|---|---|
| 488,562 | A | * | 12/1892 | Holden | 15/44 |
| 1,066,201 | A | | 7/1913 | Fulper | |
| 1,752,034 | A | * | 3/1930 | Spencer | 15/403 |
| 1,992,986 | A | * | 3/1935 | Bender | 15/383 |
| 2,769,995 | A | | 11/1956 | Klein | |
| 2,873,465 | A | * | 2/1959 | Miller | 15/410 |
| 3,099,855 | A | | 8/1963 | Nash | |
| 3,321,331 | A | * | 5/1967 | McNeely | 401/22 |
| 3,599,272 | A | | 8/1971 | Merrick | 15/321 |
| 3,745,605 | A | | 7/1973 | Gitschel et al. | 15/364 |
| 3,992,747 | A | | 11/1976 | Hufton | 15/321 |
| 4,266,317 | A | | 5/1981 | Duda | 15/322 |
| 4,369,544 | A | * | 1/1983 | Parisi | 15/380 |
| 4,433,451 | A | * | 2/1984 | Parisi | 15/51 |
| 4,833,752 | A | | 5/1989 | Merrick | 15/322 |
| 5,001,806 | A | | 3/1991 | Gurstein | 15/322 |
| 5,241,724 | A | | 9/1993 | Lim | 15/322 |
| 5,392,491 | A | | 2/1995 | Hwang et al. | 15/322 |
| 5,400,467 | A | | 3/1995 | Hwang | 15/364 |
| 5,525,397 | A | | 6/1996 | Shizuno et al. | 15/208 |
| 5,697,119 | A | | 12/1997 | Mussalo | 15/320 |
| 5,819,366 | A | | 10/1998 | Edin | 15/322 |
| 5,857,239 | A | | 1/1999 | Oh et al. | 15/321 |
| 5,909,755 | A | | 6/1999 | Leal | 15/325 |

(Continued)

FOREIGN PATENT DOCUMENTS

EP 1 027 855 A2 8/2000

(Continued)

*Primary Examiner*—Theresa T. Snider
(74) *Attorney, Agent, or Firm*—McGarry Bair PC

(57) ABSTRACT

A battery-powered, upright vacuum sweeper comprises a base assembly and a handle pivotably attached thereto. The base assembly comprises a vacuum fan assembly fluidly communicating with an inlet for vacuuming dust and the debris particles from a surface into a removable reservoir. A rotating roller brush attached to the base assembly sweeps the particles into the inlet. A dust pad assembly comprises a disposable dust cloth extending over a portion of the base assembly in contact with the surface to be cleaned for removing dust particles which are not removed by vacuuming.

37 Claims, 20 Drawing Sheets

U.S. PATENT DOCUMENTS

| | | | | |
|---|---|---|---|---|
| 6,305,046 | B1 | 10/2001 | Kingry et al. | 15/231 |
| 6,345,411 | B1 | 2/2002 | Kato et al. | 15/412 |
| 2002/0194693 | A1 * | 12/2002 | Wu | 15/322 |
| 2003/0159223 | A1 * | 8/2003 | Plankenhorn | 15/380 |
| 2004/0031121 | A1 * | 2/2004 | Martin et al. | 15/403 |
| 2004/0134025 | A1 * | 7/2004 | Murphy et al. | 15/403 |
| 2004/0139572 | A1 * | 7/2004 | Kisela et al. | 15/403 |
| 2004/0148732 | A1 * | 8/2004 | Allard-Latour et al. | 15/415.1 |
| 2004/0168281 | A1 * | 9/2004 | Sako et al. | 15/364 |
| 2004/0250376 | A1 * | 12/2004 | Hori et al. | 15/403 |
| 2005/0076468 | A1 * | 4/2005 | Matousek et al. | 15/403 |
| 2005/0181968 | A1 * | 8/2005 | Policicchio et al. | 15/201 |

FOREIGN PATENT DOCUMENTS

| | | | |
|---|---|---|---|
| GB | 2 271 275 | A | 4/1994 |
| JP | 10014829 | A | 1/1998 |
| JP | A-H10-52386 | | 2/1998 |
| JP | 11253369 | | 9/1999 |

* cited by examiner

FLOOR CLEANER WITH DUSTING

CROSS REFERENCE TO RELATED APPLICATIONS

This application claims the benefit of U.S. Provisional Application Ser. No. 60/352,350, filed Jan. 28, 2002, entitled "Vacuum Cleaner with Dusting Pad" and U.S. Provisional Application Ser. No. 60/319,594, filed Oct. 3, 2002, entitled "Sweeper with Dusting Pad."

BACKGROUND OF INVENTION

1. Field of the Invention

The invention relates to floor cleaners. In one of its aspects, the invention relates to sweepers with dust cloths for cleaning hard surfaces such as bare floors. In another of its aspects, the invention relates to a bare floor vacuum cleaner incorporating a dusting cloth for capturing small dust-sized particles not removed by vacuuming. In another of its aspects, the invention relates to a rechargeable battery-powered vacuum cleaner incorporating a dusting cloth. In yet another of its aspects, the invention relates to a sweeper incorporating an indefinite length dusting cloth that for ease of replacement of used dusting cloth portions. In yet another of its aspects, the invention relates to a sweeper incorporating an easily mounted and demounted dusting cloth for capturing small dust-sized particles not removed by the sweeper.

2. Description of the Related Art

Vacuum sweepers are ubiquitous for cleaning smooth surfaces, such as flooring, found in homes, offices, and other establishments. One example of such a device is a cordless sweeper manufactured and sold by BISSELL Inc. under the trademark GOVAC. Such a device typically includes a housing for movement across a surface to be cleaned, a brush centered in an inlet nozzle and rotated by an electric motor, and a rechargeable battery pack. A vacuum motor and fan assembly is affixed to the housing and fluidly communicates with the inlet nozzle and a dirt cup having a removable filter. As the fan assembly is turned by the vacuum motor, air is pulled through the sweeper from the nozzle into the dirt cup, through the filter and the fan assembly, and out of the sweeper through exhaust vents.

Vacuuming frequently fails to completely remove minute particles which cling to the surface under the influence of static electricity. The typical vacuum sweeper can remove large particles; removal of small dust-like particles will necessitate a separate cleaning operation.

Dust mops, and sweepers utilizing disposable cloths, can be effective in removing small dust particles from the surface. U.S. Pat. No. 3,099,855 to Nash, issued Aug. 6, 1963, and U.S. Pat. No. 6,305,046 to Kingry et al., issued Oct. 23, 2001, disclose a cleaning implement comprising a panel-shaped head with an attached handle and a removable cleaning cloth. An example of such a cleaning cloth is described in U.S. Pat. No. 5,525,397 to Chizuno. A resilient foam pad may be bonded to the head to provide a cushioned surface against which the cleaning cloth is supported. The cleaning cloths can be either dry or wet. Dry cloths use an electrostatic charge to attract small particles which are retained in a web of specially-designed fibers for later disposal with the cloth. Wet cloths perform a similar function, but are impregnated with proprietary floor cleaners and polishers. Such devices are effective in removing dust particles, but are generally of limited effectiveness as the size of the particle increases. Thus, in order to completely clean the surface, two cleaning operations, vacuuming and dusting, must be performed.

The U.S. Pat. No. 5,392,491 to Hwang et al. discloses a cleaner head for a vacuum cleaner that incorporates a mop to mop a bare floor after vacuuming.

It would be advantageous to combine the removal of large dust and debris particles from a surface through a vacuuming or sweeping operation with the removal of small, dust-sized particles in a single cleaning operation, thus improving cleaning performance and facilitating the cleaning operation.

SUMMARY OF INVENTION

According to the invention, a sweeper comprises an upright handle pivotally mounted to a base assembly that is adapted to move along a surface to be cleaned. The base assembly has a nozzle opening and a driven brush assembly mounted for rotation in the nozzle opening for removing debris particles from the surface. A dirt cup assembly is operatively associated with the nozzle opening for receiving the debris particles removed from the surface to be cleaned. According to the invention, a dust cloth for removing dust from the surface to be cleaned is mounted to an underside of the base for removing dust from the floor. Typically, the nozzle opening is at a front portion of the base assembly and the dust cloth is mounted to a rear portion of the base assembly.

In one embodiment, a motor-driven vacuum fan assembly is in fluid communication with the dirt cup assembly for moving the debris particles from the roller brush assembly into the dirt cup assembly.

Further, a vacuum cleaner comprises an upright handle pivotally mounted to a base assembly, which is adapted to move along a surface to be cleaned. A nozzle opening formed in a bottom side of the base for removing debris particles from the surface and a dirt receptacle is fluid communication with the nozzle opening for receiving the debris particles removed from the surface. A motor-driven vacuum fan assembly is in fluid communication with the dirt receptacle for moving the debris particles from the nozzle opening into the dirt receptacle. According to the invention, a dust cloth for removing dust from the surface to be cleaned is mounted to an underside of the base for removing dust from the floor.

In a preferred embodiment, a dust cloth panel removably mounts the dust cloth and is mounted to the base assembly for movement away from the base assembly for service of the dust cloth. In one embodiment, the dust cloth panel is removably mounted to the base assembly. In another embodiment, the dust cloth panel is hinged to the base assembly for selectively pivoting the dust cloth panel between a first, open position away from the underside of the base assembly for removal and mounting of the dust cloth to the dust cloth panel and a second, closed position in operative position with the base assembly.

Preferably, a pad is attached to a lower surface of the dust cloth panel for supporting the dust cloth against the surface to be cleaned. Desirably, the pad is a resilient pad.

At least one first cloth retainer, and preferably two cloth retainers, are mounted to an upper surface of the dust cloth panel for retaining a first portion of the dust cloth on the dust cloth panel. At least one second cloth retainer, and preferably two cloth retainers, are mounted to an upper portion of the base assembly for retaining a second portion of the dust cloth on the base assembly, whereby the dust cloth is positioned over a second, lower panel surface to remove dust from the surface as the base assembly is maneuvered over the surface.

In one embodiment, the dust cloth is attached to a roll of said dust cloths mounted to the base assembly and the at least one first cloth retainer comprises the roll of dust cloths.

In one embodiment, the sweeper is preferably battery powered. A battery pack is mounted to the base assembly and is connected to a motor for the vacuum fan assembly to supply electric power thereto.

In another embodiment, the dirt cup and the motor-driven fan assembly are connected by an air duct and the handle is mounted for rotation about the air duct.

DETAILED DESCRIPTION

Figure 1:
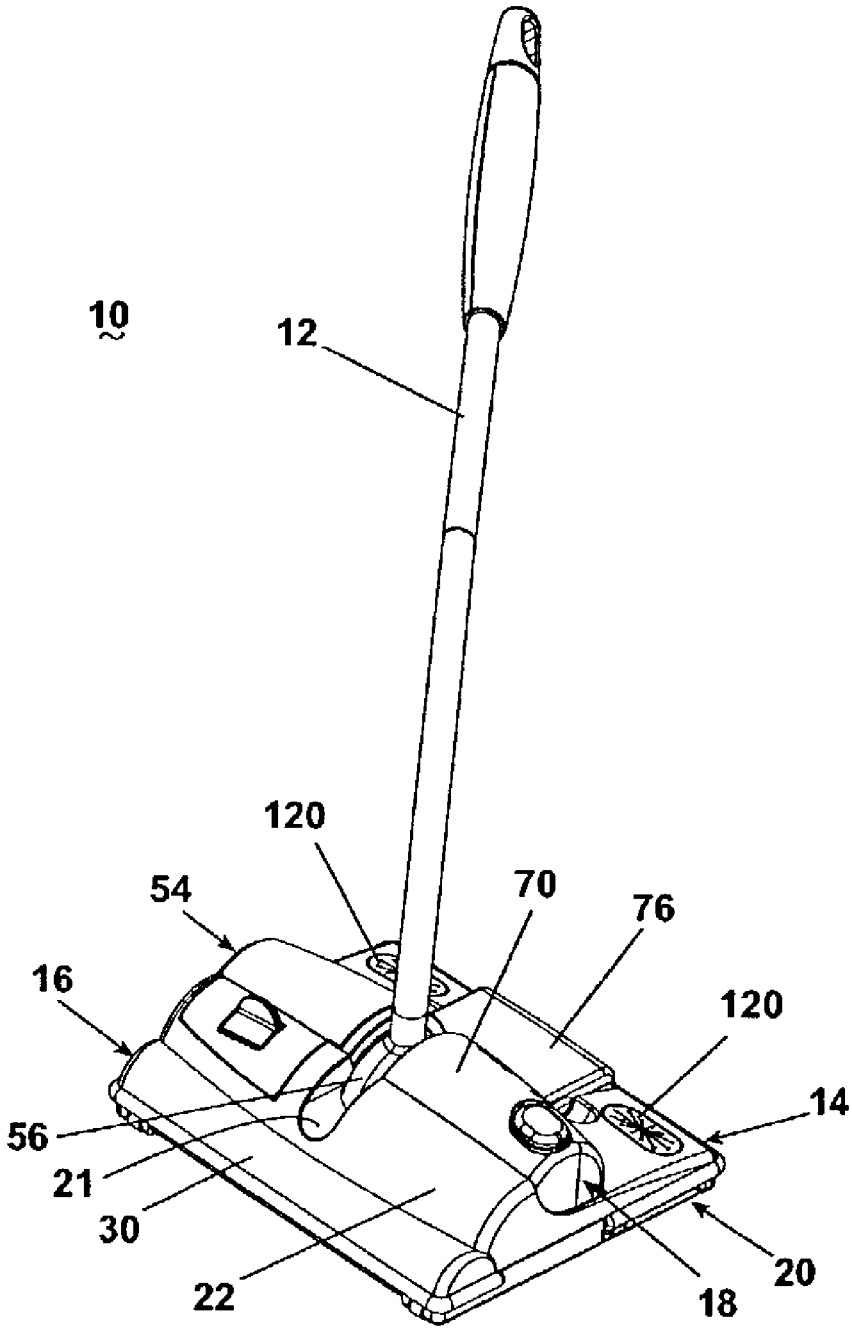
FIG. 1 is a perspective view of a first embodiment of a vacuum sweeper with an integral dusting surface according to the invention.

Referring now to the drawings and to FIG. 1 in particular, a first embodiment of the invention is shown comprising an upright, battery-powered vacuum sweeper 10. The vacuum sweeper 10 comprises an upright handle 12 for maneuvering the vacuum sweeper 10, which is pivotally attached to a base assembly 14 for rotation between an upright position rearwardly and forwardly so that the vacuum sweeper can be operated from either front or rear. As shown also in FIGS. 2–6, the base assembly 14 is a generally compact assemblage comprising various components of a vacuum sweeper, including a roller brush assembly 16, a vacuum fan assembly 18, and a dirt cup assembly 54. According to one embodiment of the invention, the vacuum sweeper 10 additionally comprises a dust pad assembly 20, as hereinafter described. The roller brush assembly 16, the vacuum fan assembly 18, the dirt cup assembly 54, and the dust pad assembly 20 are enclosed within a housing generally comprising an upper cover 22, a base plate 24, and a roller brush cover 30.

Figure 4:
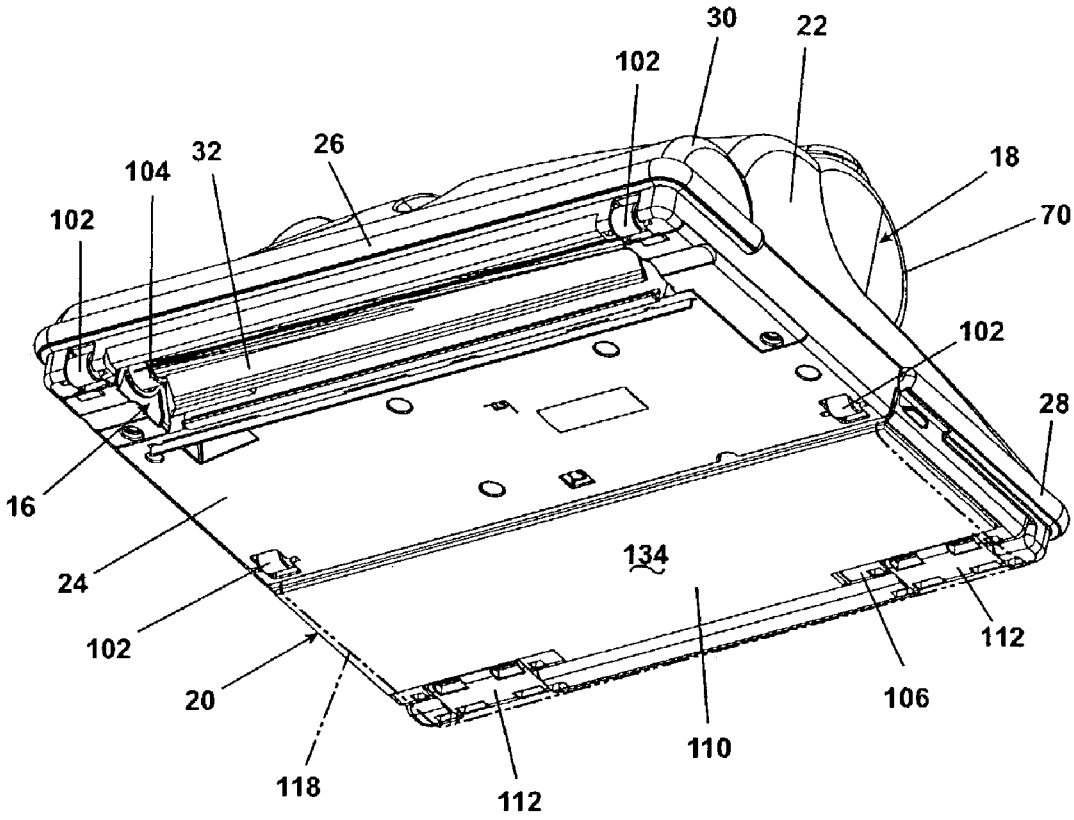
FIG. 4 is a bottom perspective view of the base assembly shown in FIG. 1.
Figure 5:
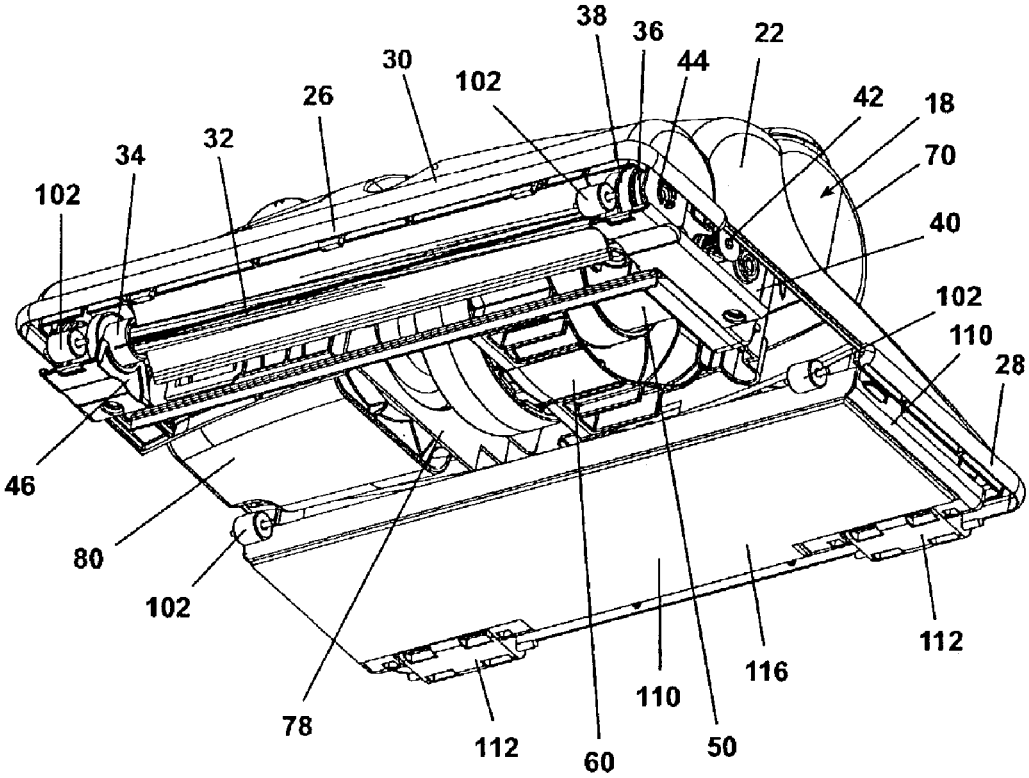
FIG. 5 is a bottom perspective view of the base assembly shown in FIG. 4 with a base plate removed.
Figure 6:
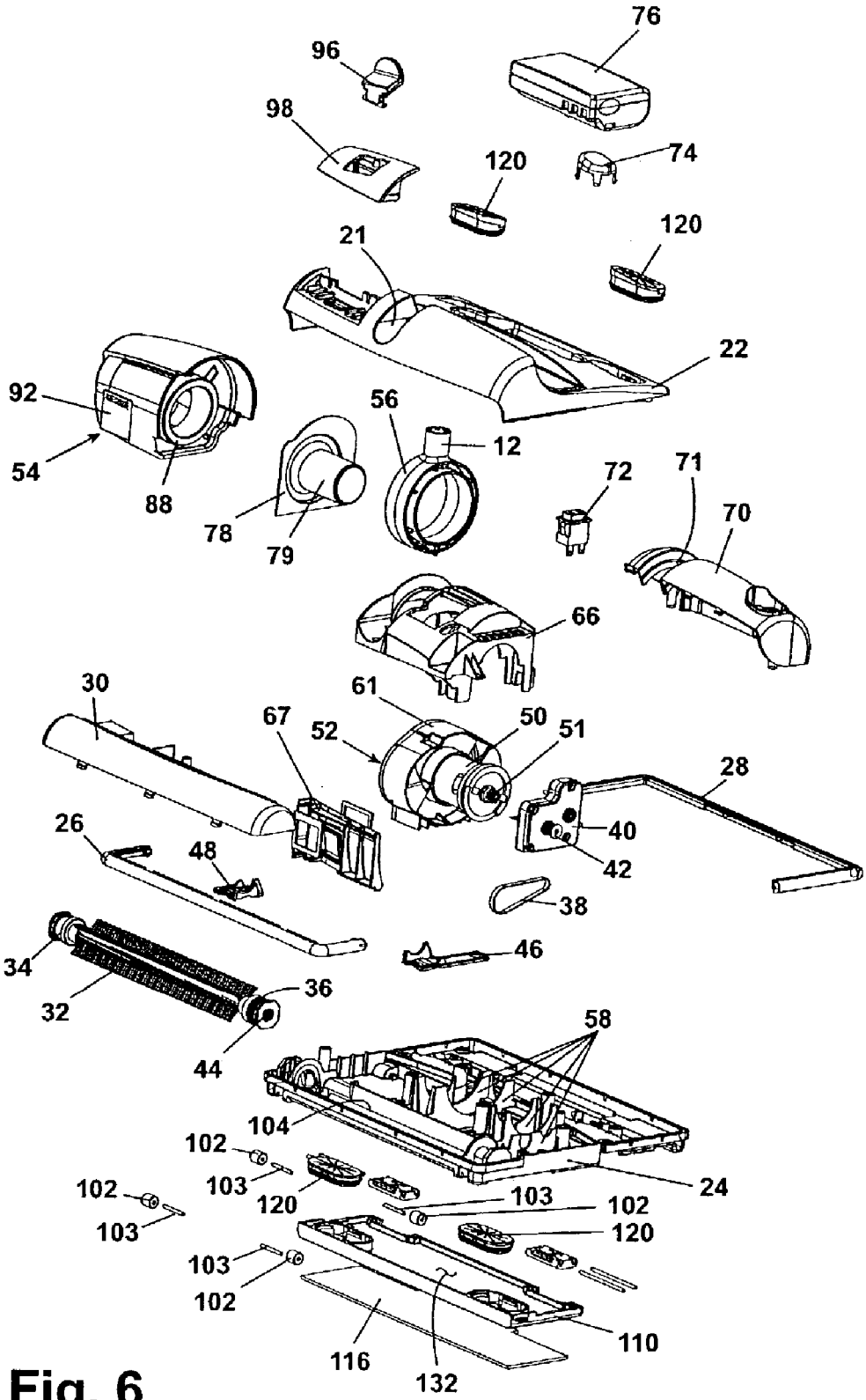
FIG. 6 is an exploded view of the base assembly shown in FIG. 1.
Figure 7:
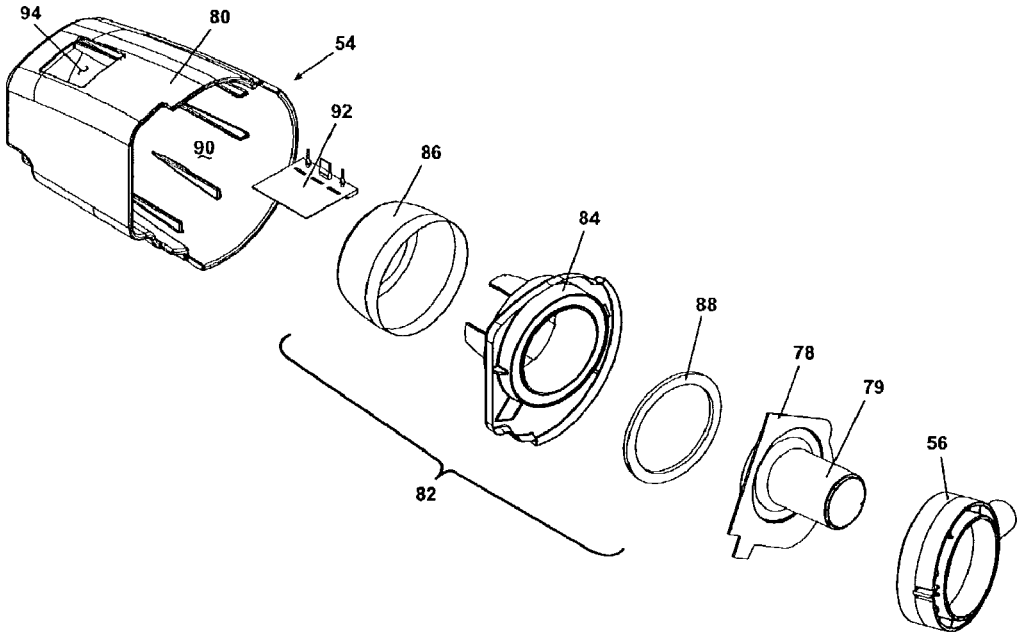
FIG. 7 is an exploded view of the dust cup assembly shown in FIG. 2.
Figure 8:
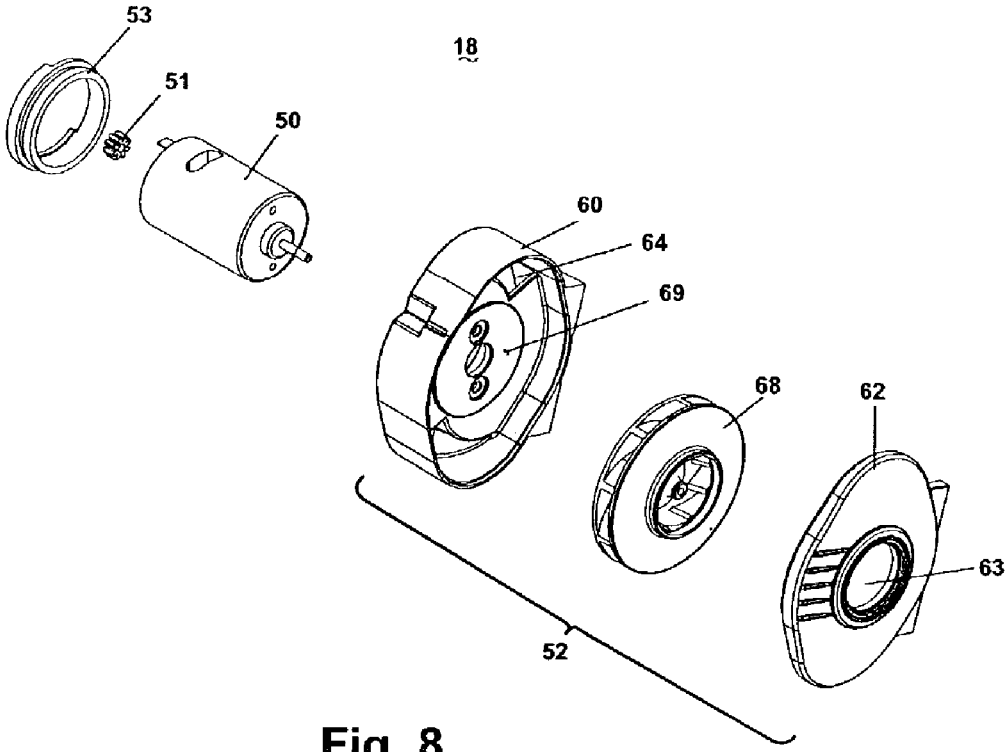
FIG. 8 is an exploded perspective view of the vacuum fan assembly shown in FIG. 2.

Referring particularly to FIGS. 4–6, the base plate 24 comprises a panel-like body of suitable size and shape incorporating various-sized cradles (designated collectively by the number 58) for fixedly supporting the roller brush assembly 16, the vacuum fan assembly 18, the dirt cup assembly 54, and the dust pad assembly 20 in operable juxtaposition. The base plate 24 is provided at a first end with an elongated, generally rectangular-shaped roller brush slot 104 extending therethrough. As shown also in FIGS. 4 and 5, support rollers 102 are rotatably attached to the base plate 24 through axle pins 103 for supporting and maneuvering the vacuum sweeper 10 over the surface to be cleaned. The base plate 24 can also be provided with resilient bumpers 26, 28 to cushion any contact between the base assembly 14 and walls or furniture during use of the vacuum sweeper 10.

Referring to FIGS. 3, 5, 6, and 8–11, the vacuum fan assembly 18 comprises a vacuum motor 50 and a fan assembly 52. The vacuum motor 50 comprises a generally conventional, direct current electric motor having sufficient power for the purposes described herein, which is operably connected to the fan assembly 52 as hereinafter described.

The fan assembly 52 comprises a fan impeller 68 housed within an impeller housing 61 comprising a fan assembly cover 60 and a fan assembly end cover 62. The fan assembly end cover 62 is joined to the fan assembly cover 60 through an air-tight interference fit to define a fan impeller chamber 69 in which the fan impeller 68 can rotate. The fan assembly end cover 62 is provided with an air inlet aperture 63 through the center thereof through which air can flow into the impeller chamber 69. The fan assembly cover 60 is provided with a pair of diametrically opposed exhaust apertures 64 for air flow out of the impeller chamber 69 and along the outer surface of the vacuum motor 50.

Figure 2:
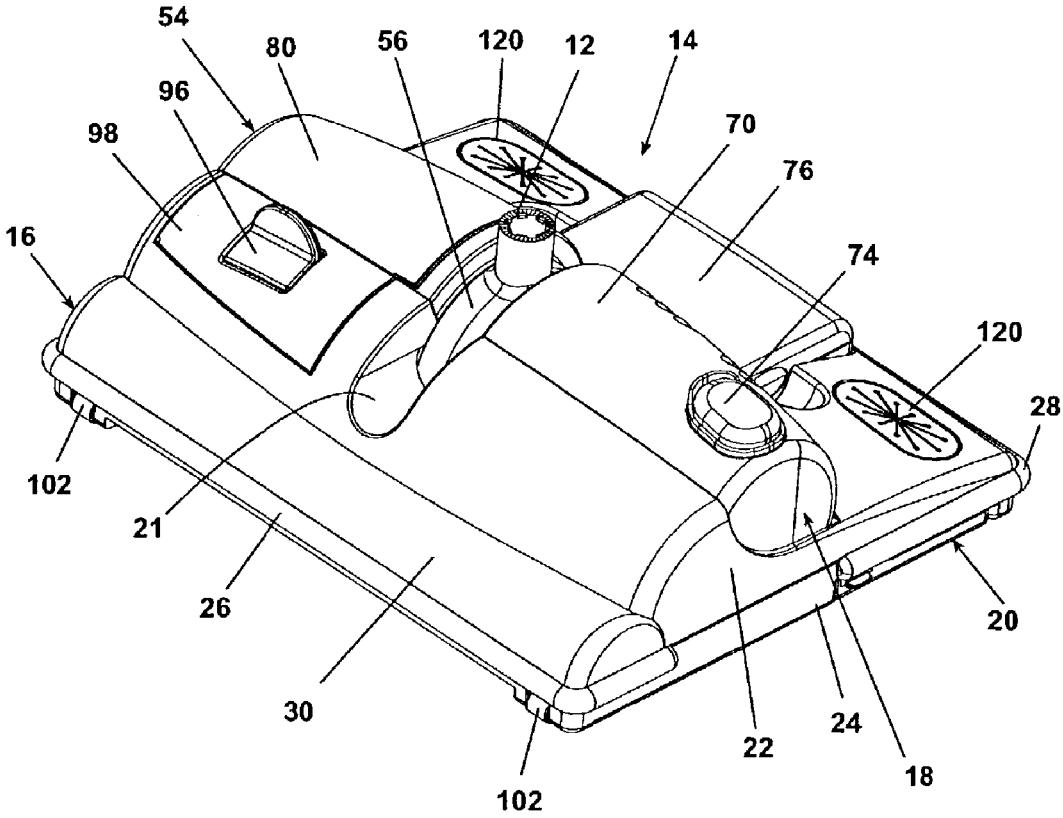
FIG. 2 is a top perspective view of the base assembly shown in FIG. 1.
Figure 9:
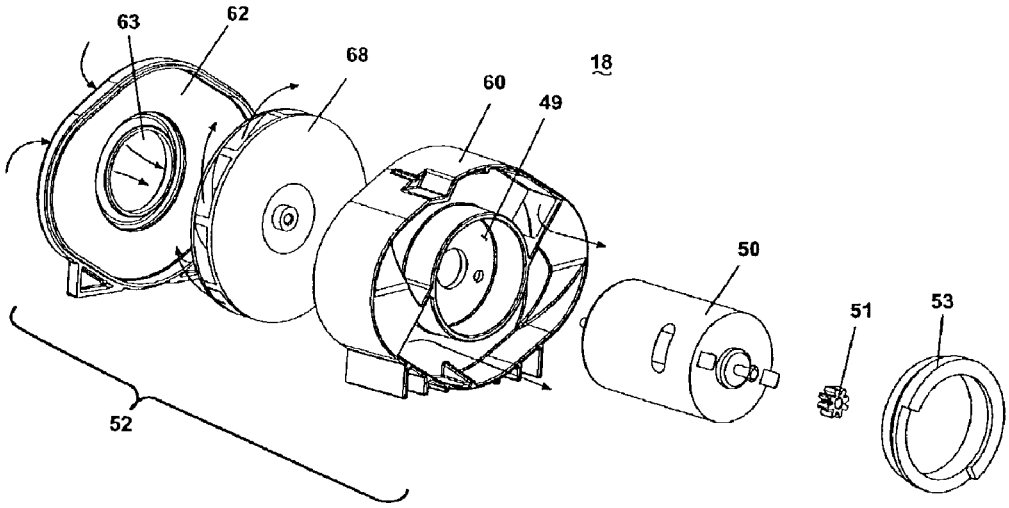
FIG. 9 is an exploded side elevation view of the vacuum fan assembly shown in FIG. 2.

The fan impeller 68 is fixedly attached to the shaft of the vacuum motor 50 for coaxial rotation of the fan impeller 68 with rotation of the vacuum motor 50. As shown in FIG. 9, the fan assembly cover 60 is provided with a motor seat 49 into which the vacuum motor 50 is fixedly seated. The vacuum motor 50 is electrically connected in a conventional manner to a switch 72 and a rechargeable battery pack 76 for selectively activating and deactivating the vacuum motor 50. As shown in FIG. 2, the battery pack 76 is retained in a suitable receptacle in the upper cover 22, and can be recharged by a well-known on-board charger (not shown) while installed in the base assembly 14, or alternatively by removing the battery pack 76 to a charging base (not shown) for recharging.

Figure 11:
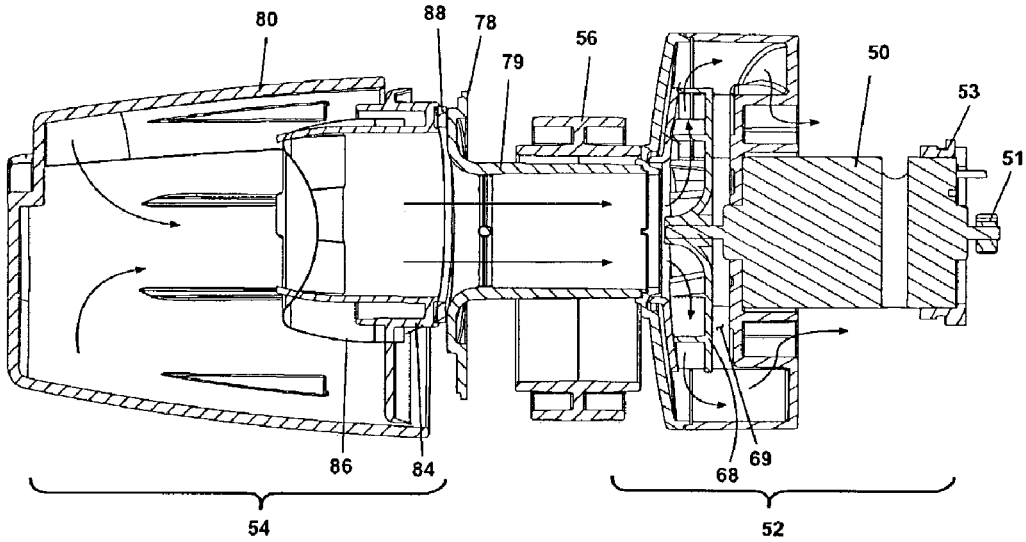
FIG. 11 is a sectional view of the vacuum fan assembly, the dust cup assembly, and the handle pivot ring taken along line 11—11 of FIG. 10.

The fan impeller 68 and impeller housing 61 are fluidly adapted so that rotation of the fan impeller 68 will induce air to flow through the air inlet aperture 63 and into the fan impeller chamber 69 as indicated by the air flow vectors shown in FIGS. 9 and 11. The motor 50 is mounted to a resilient mounting ring 53 which is slidably received in a suitable mating receptacle (not shown) in the cradles 58 for supporting the motor 50 while damping motor-induced vibrations into the base assembly 14. The vacuum fan assembly 18 is held to the base plate 24 through suitable cradles 58 in the base plate 24, and secured to the base plate 24 with a fan assembly frame 66 and a fan mounting frame 67 which enclose the vacuum fan assembly 18 and are attached to the base plate 24 through a suitable number of conventional connectors, such as threaded screws or rivets. A fan assembly housing 70 encloses the fan assembly frame 66, the fan mounting frame 67, and the vacuum fan assembly 18.

Referring to FIGS. 3, 5, 6, 7, 10, and 11, the dirt cup assembly 54 comprises a dirt cup 80 defining a dirt chamber 90, and a filter assembly 82 comprising a filter frame 84, a cup-like filter element 86, and an annular filter gasket 88. The filter element 86 comprises a fibrous material, such as paper or fabric, having voids through which air can flow which are small enough to trap dust and debris particles. The filter frame 84 provides structural support to the filter element 86 and serves as an end closure for the dirt cup 80. The dirt cup 80 is provided with a radial inlet 94 for fluid communication of the dirt chamber 90 with the roller brush slot 104. The dirt chamber 90 fluidly communicates through a suitable airflow passageway (not shown) with the roller brush slot 104. The inlet 94 is provided with a dirt cup flap 92 which is biased to a closed position over the inlet 94, but which will open into the dirt chamber 90 under the influence of air flowing from the roller brush slot 104 into the dirt cup assembly 54. The filter frame 84 and the filter element 86 are interference fit to the dirt cup 80 so that air flowing into the dirt chamber 90 through the inlet 94 will flow out of the dirt cup 80 through the filter element 86, thereby trapping any dust or debris removed from the surface by the vacuum sweeper 10.

Figure 10:
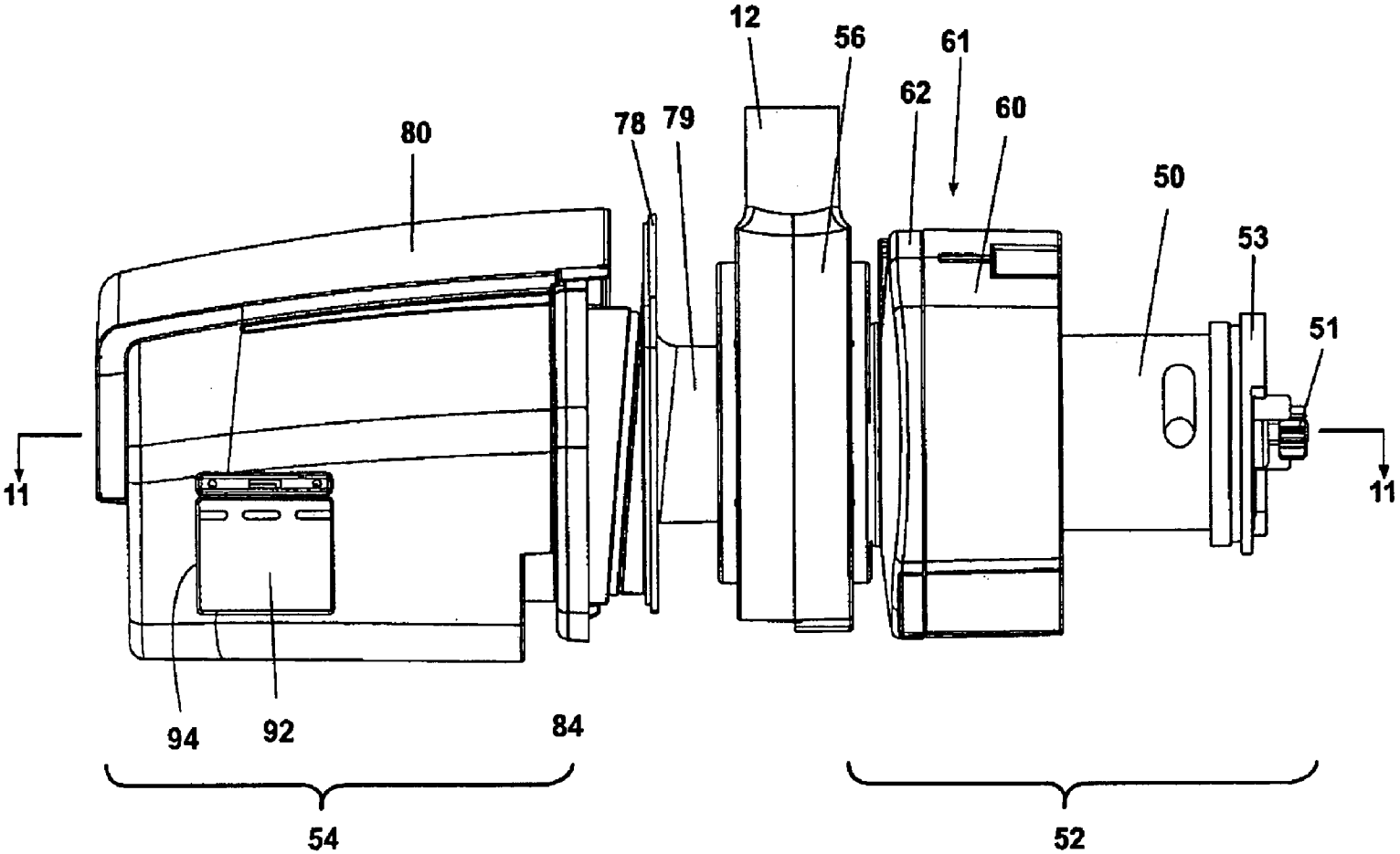
FIG. 10 is an assembled side elevation view of the vacuum fan assembly, the dust cup assembly, and the handle pivot ring shown in FIG. 1 in an assembled configuration.

A fan inlet plate 78 is a plate-like body having a fan inlet duct 79 extending orthogonally there from and defining an aperture therethrough for fluid communication with the dirt chamber 90. The annular filter gasket 88 is inserted between the filter frame 84 and the fan inlet plate 78 to provide an air-tight seal between the filter frame 84 and the fan inlet plate 78 when the filter frame 84 and of the fan inlet plate 78 are brought into coaxial alignment as shown in FIG. 11. As shown in FIGS. 10 and 11, the fan inlet duct 79 fluidly communicates with the air inlet aperture 63 when the vacuum fan assembly 18 and the dirt cup assembly 54 are installed in the base assembly 14. Thus, air can flow from the dirt chamber 90 through the filter element 86 and the fan inlet duct 79 into the fan impeller chamber 69 as shown by the air flow vectors in FIG. 11.

Figure 3:
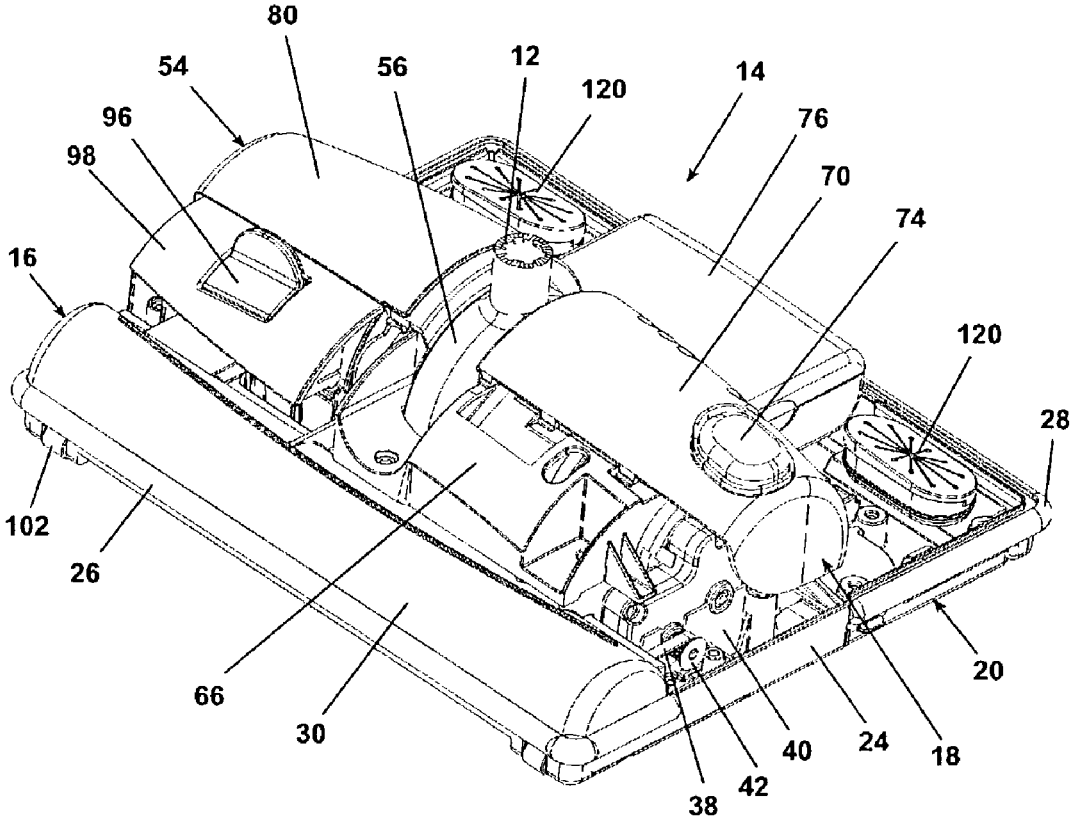
FIG. 3 is a top perspective view of the base assembly shown in FIG. 2 with the upper cover removed.

The dirt cup assembly 54 is held in the base assembly 14 by a cradle comprising a portion of the upper cover 22 and a dirt cup retainer frame 98 into which the dirt cup assembly 54 is slidably received so that the dirt cup assembly 54 is coaxially aligned with the vacuum fan assembly 18. The dirt cup assembly 54 is held in the base assembly 14 by a suitable releasable locking mechanism of a type well-known in the art, such as a release latch 96 retained in the dirt cup retainer frame 98, as shown in FIG. 3. When the dirt cup assembly 54 is properly installed in the base assembly 14, air can flow through the roller brush slot 104 and the inlet 94, into the dirt chamber 90, where dust or debris is retained by the filter element 86 and the dirt cup flap 92. Dust-free air will be drawn through the filter element 86 and through the fan inlet duct to the vacuum fan assembly 52 where it will be exhausted from the fan impeller chamber 69 through the exhaust apertures 64 and along the outer surface of the vacuum motor 50.

As shown in FIGS. 10 and 11, the upright handle 12 is pivotally connected to the center of the base assembly 14 through a pivot ring 56, which is rotatable about the fan inlet duct 79 both forwardly and rearwardly with respect to the base. The pivot ring 56 can be pivotally attached to the base assembly 14 through a suitable arrangement of bearings, which, in the embodiment described herein, are shown as comprising a portion of the fan assembly frame 66, so that the pivot ring 56 and the handle 12 can pivot forward and rearward of the base assembly 14 about a horizontal axis coaxial with the vacuum fan assembly 18 and the dirt cup assembly 54. Alternately, the pivot ring can be mounted directly to the inlet duct 79. As illustrated in FIGS. 1–3, the cover has an indented slot 21 and the fan assembly housing 70 has a like indented slot 71 in which the handle rotates forwardly and rearwardly. The two slots 21, 71 define an opening of about 180 degrees about the inlet duct 79 through which the handle 12 can rotate when the vacuum sweeper is in use.

As shown in FIGS. 5 and 6, the roller brush assembly 16 is of a configuration generally well-known in the art and comprises a roller brush 32 which is centrally positioned in the roller brush slot 104 and held to the base plate 24 by an end bearing 34 and a belt bearing 44 inserted into bearing seats 46, 48, respectively, attached to the base plate 24 so that the roller brush 32 can rotate about a horizontal axis to sweep particles through the roller brush slot 104 to be drawn by the vacuum fan assembly 18 into the dirt cup 80. The roller brush 32 is driven by vacuum motor 50 through drive gear 51, a speed reducer gear box 40, a flexible drive belt 38 and a belt pulley 36. The gearbox 40 comprises an enclosed assemblage of gears that reduce the speed of the motor shaft. The gearbox 40 is mounted to the fan assembly frame 52 and drives the drive pulley 42 that drives the drive belt 38, which will in turn rotate the belt pulley 36 and the roller brush 32.

Referring to FIGS. 3–6 and 12, the dust pad assembly 20 comprises the dust cloth panel 110, a resilient pad 116, a dust cloth 118, and a plurality of cloth retainers, shown in FIGS. 3–6 and 12 as cloth retainers 120. The dust cloth 118 comprises a dry fabric, preferably electrostatically-charged, or alternatively a liquid cleaner/polisher-impregnated fabric. Examples of suitable cleaning cloths are disclosed in U.S. Pat. No. 3,099,855 to Nash, U.S. Pat. No. 6,305,046 to Kingry et al., and U.S. Pat. No. 5,525,397 to Chizuno, which are incorporated herein by reference. The dust cloth panel 110 is a generally flattened, rectilinear body having an upper surface 132 and a lower surface 134, which is pivotally connected to the base plate 24 through a pair of spaced-apart hinges 112. The hinges 112 are mounted through hinge pins 114 to a first panel edge so that the dust cloth panel 110 can pivot between an opened and a closed position relative to the base plate 24.

Figure 12:
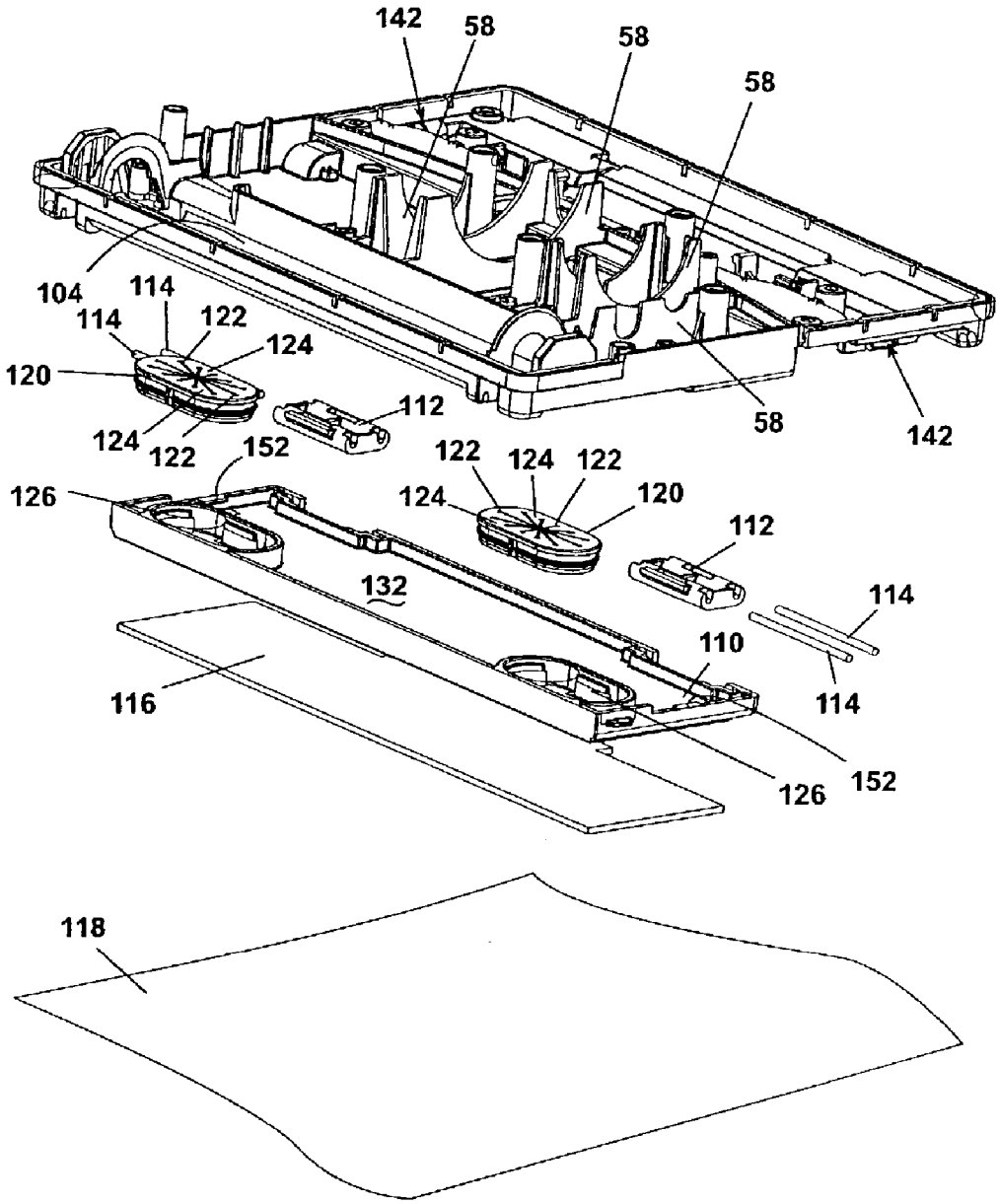
FIG. 12 is an exploded perspective view of the dust pad assembly shown in FIG. 2.
Figure 16:
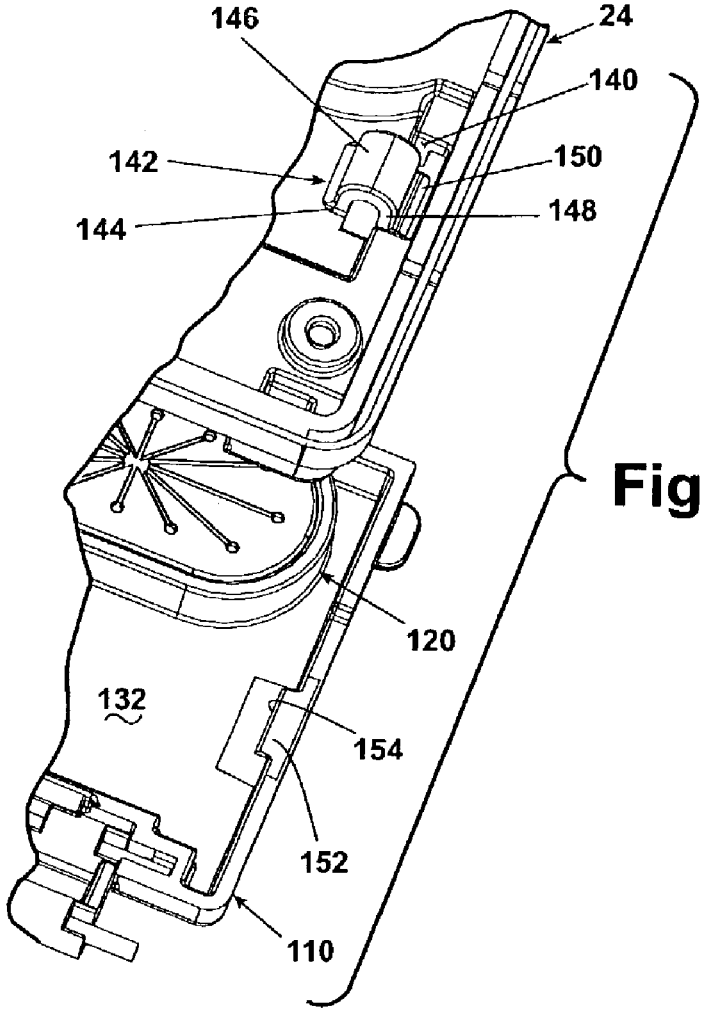
FIG. 16 is a close-up perspective view of a portion of the base assembly shown in FIG. 1 illustrating a closure mechanism for the dust pad assembly comprising a latch and a catch.
Figure 17:
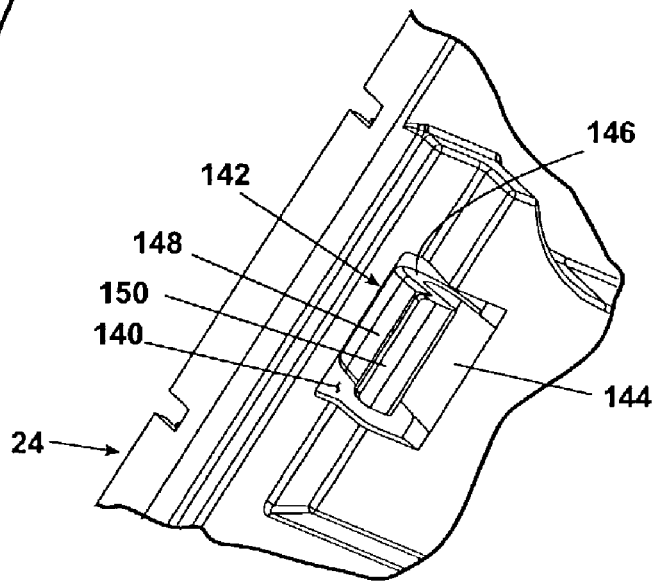
FIG. 17 is a close-up perspective view of the latch of FIG. 16.

As shown in FIG. 12, and illustrated more clearly in FIGS. 16 and 17, a closure mechanism for the dust cloth panel 110 comprises a pair of latches 142 attached to the base plate 24 and a pair of mating catches 152 comprising a part of the dust cloth panel 110. As shown in FIGS. 16 and 17, the base plate 24 is provided with a pair of generally rectilinear latch openings 140 extending through the base plate 24 adjacent the lateral edges thereof. Each latch 142 comprises a generally U-shaped body having a mounting ann 144 and a flexure arm 148 in parallel, spaced-apart juxtaposition, joined by a curved bight section 146. The flexure arm 148 terminates in a hook 150 extending laterally from the flexure arm 148 away from the mounting arm 144. The mounting arm 144 is rigidly attached to the base plate 24 so that the flexure ann 148 and the hook 150 extend through the latch opening 140 with the hook 150 extending toward the lateral edge of the base plate 24. As so attached, the fiexure aim 148 can be resiliently deflected toward the mounting arm 144. The catch 152 comprises an inwardly-extending extension of a lateral edge of the dust cloth panel 110 to form a flange 154 in generally parallel, spaced-apart juxtaposition from the upper surface 132. When the dust cloth panel 110 is moved to a closed position, the flexure arm 148 will deflect so that the latch 142 engages the catch 152 in an interference fit between the hook 150 and the flange 154 to retain the dust cloth panel 110 in the closed position. The dust cloth panel 110 can be moved to an open position by urging the dust cloth panel 110 away from the base plate 24 with sufficient force for the flexure arm 148 to deflect and enable the hook 150 to unhook from the flange 154.

The upper surface 132 is provided with a first pair of cloth retainer seats 126 adjacent a second panel edge, and the lower surface 134 is adapted to fixedly receive a resilient pad 116. The cloth retainer seats 126 comprise suitable receptacles in which a first pair of cloth retainers 120 is fixedly retained. The base plate 24 is provided with a second pair of cloth retainer seats 126 for receiving a second pair of cloth retainers 120, which are accessible through apertures in the upper housing 22, as shown in FIG. 2. The resilient pad 116 is a plate-like body approximately equal in area to the dust cloth panel 110, and is fixedly attached to the lower surface 134 to provide a cushioned surface for supporting the dust cloth 118 against the surface to be cleaned.

Figure 13A:
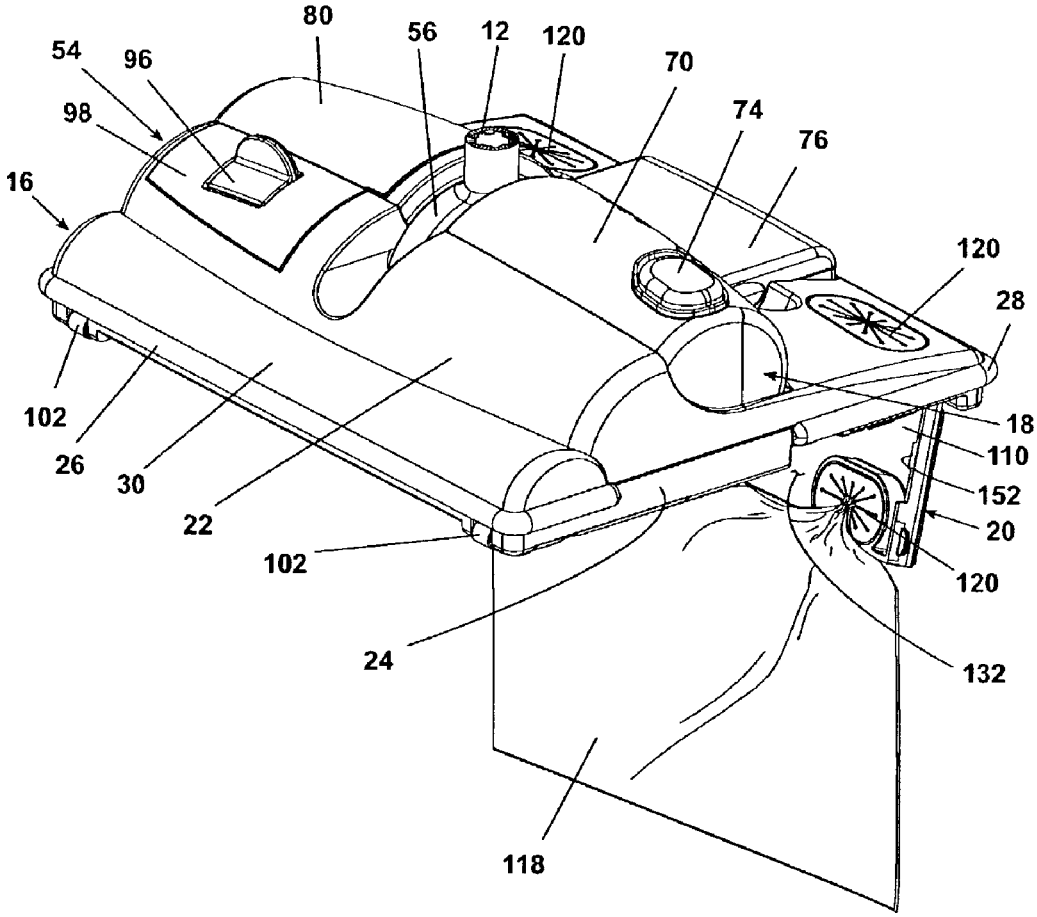
FIG. 13A is a perspective view of the base assembly shown in FIG. 1 showing a first step in the installation of a dust cloth to the dust pad assembly.

The cloth retainers 120 are shown in FIG. 12 preferably as flattened, generally oval-shaped bodies adapted to be fixedly retained in the cloth retainer seats 126. Examples of such cloth retainers are disclosed in U.S. Pat. No. 3,099,855 to Nash, and U.S. Pat. No. 6,305,046 to Kingry et al. The cloth retainers 120 are provided with a plurality of radially-extending slits 122 in a spoke-like pattern to form a plurality of triangular-shaped, deformable flaps 124 for holding a corner of the dust cloth 118, as shown in FIGS. 13A and 13C. It will be evident that the cloth retainers 120 can be any suitable shape, such as circular or triangular, so long as a suitable number of slits 122 and flaps 124 are provided to securely hold the dust cloth 118 in place.

Figure 13B:
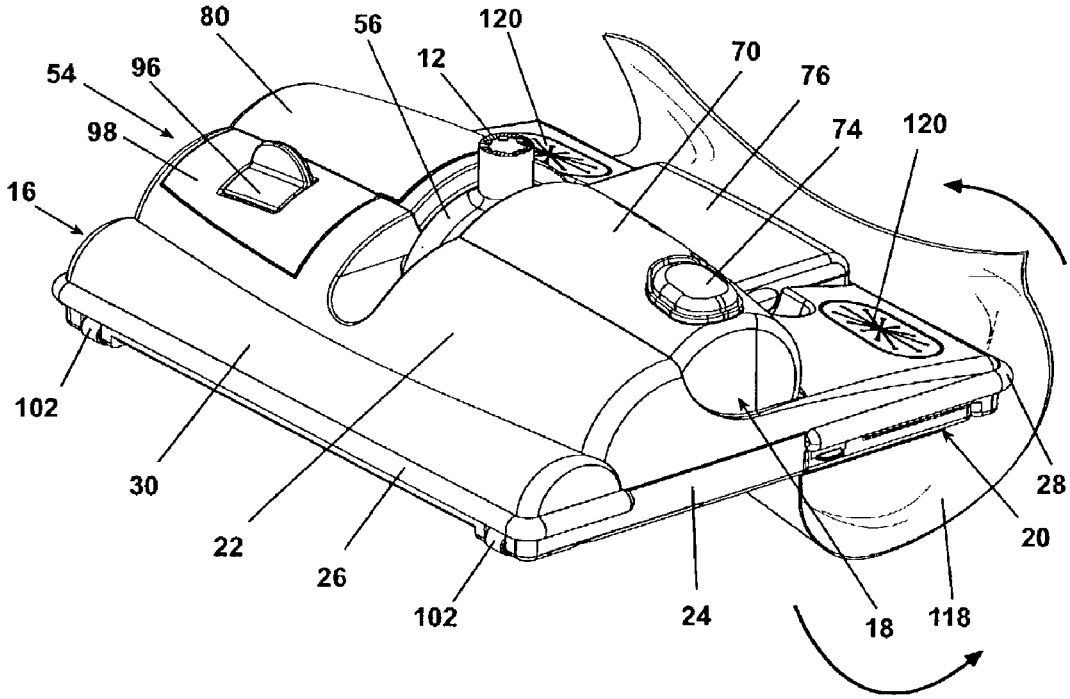
FIG. 13B is a perspective view of the base assembly shown in FIG. 13A showing a second step in the installation of a dust cloth to the dust pad assembly.
Figure 13C:
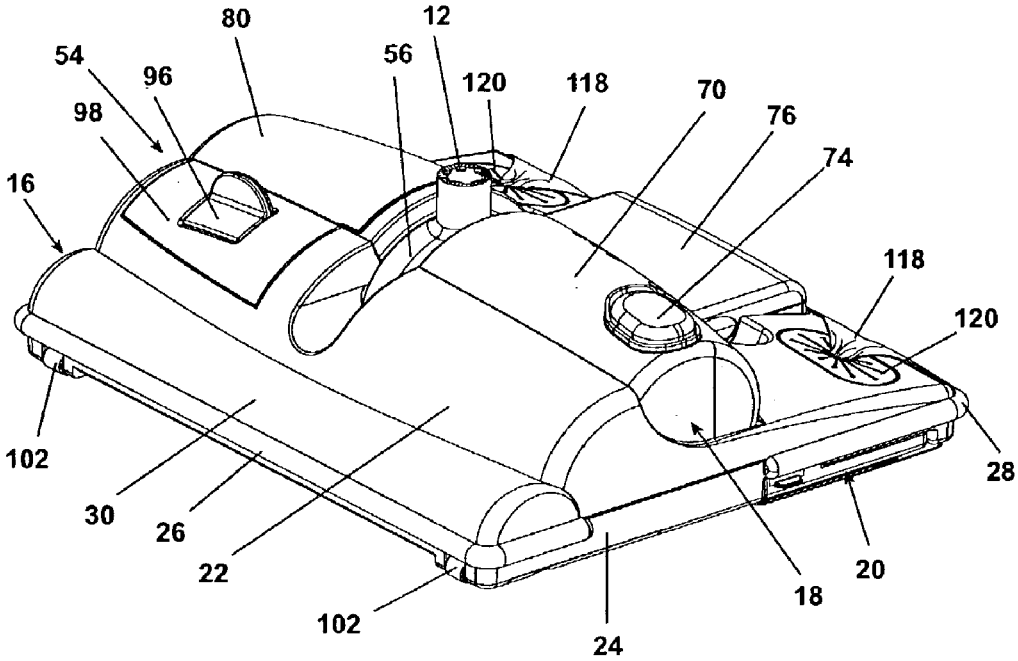
FIG. 13C is a perspective view of the base assembly shown in FIG. 13A showing a third step in the installation of a dust cloth to the dust pad assembly.

Referring now to FIGS. 13A–13C, the dust cloth 118 is first attached to the dust cloth panel 110 by inserting two corners of the dust cloth 118 in the first pair of cloth retainers 120 attached to the upper surface 132, as shown in FIG. 13A. The dust cloth panel 110 is then pivoted to a closed position, and the dust cloth 118 is brought forward around the front edge of the base assembly 14 as shown in FIG. 13B. The remaining two corners of the dust cloth 18 are then inserted into the second pair of cloth retainers 120 to retain the dust cloth 118 in place as shown in FIG. 13C.

The vacuum sweeper 10 can be operated as a combination vacuum cleaner and duster, a vacuum cleaner alone or as a duster alone. The handle 12 can be pivoted in a first direction so that the roller brush assembly 16 is positioned in a forward direction for vacuuming and dusting. Alternatively, the handle 12 can be pivoted in a second direction so that the dust pad assembly 20 is positioned in a forward direction for dusting alone. To utilize both the vacuuming and dusting operations, the switch cover 74 is depressed, activating the switch, which electrically connects the roller brush motor 40 and the vacuum motor 50 to the battery pack 76, thereby rotating the roller brush 32 and establishing airflow into the roller brush slot 104, and through the dirt cup assembly 54 and the fan assembly 52. The base assembly 14 is maneuvered over the surface to be cleaned and the spinning of the roller brush 32 sweeps debris particles into the roller brush slot 104, where airflow set up by the rotation of the fan impeller 68 carries the particles into the dirt chamber 90. The filter assembly 82 filters the particles from the airflow. Filtered air then continues through the fan assembly 52 where it is exhausted through the exhaust apertures 64 and flows over the vacuum motor 50. At the same time, the dust cloth 118 attracts and holds dust particles on the surface coming in contact with the dust cloth 18 to completely clean the surface. The dirt cup 80 can be removed from the base assembly 14 by the user for disposal of the contents by moving the release latch 96 to the release position to release the dirt cup 80 from the base assembly 14. The dust cloth 118 can be removed and discarded to be replaced by a new dust cloth when it no longer effectively removes dust particles.

Figure 14:
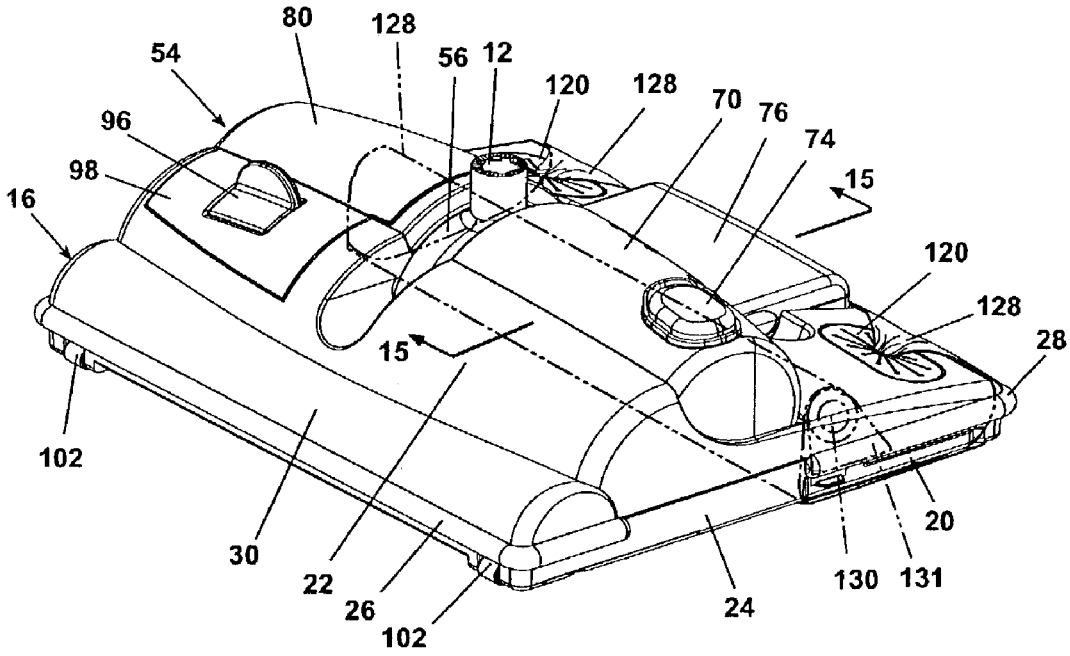
FIG. 14 is a perspective view of the base assembly shown in FIG. 1 showing an alternative embodiment of the dust pad assembly.
Figure 15:
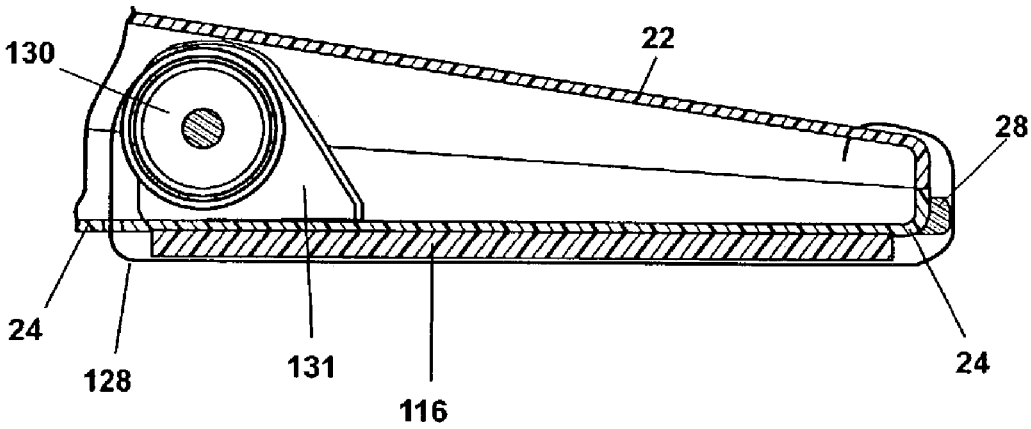
FIG. 15 is a sectional view of the dust pad assembly taken along line 15—15 of FIG. 14.

Referring to FIGS. 14 and 15, a second embodiment is shown wherein a roll of dust cloths 128 is provided on a horizontally rotating cloth supply roller 130 in place of the single cloth 118 described above. The cloth supply roller 130 is supported for horizontal rotation through suitable bearings 131, shown in FIG. 14 as attached to the upper surface 132 of the dust cloth panel 110. Alternatively, the cloth supply roller 130 can be attached to the upper housing 22 or the base plate 24. The cloth supply roller 130 can be provided with a suitable mechanism (not shown) for controlling the rotation of the cloth supply roller 130, such as a crank or ratchet mechanism, to enable a preselected length of dust cloth 128 to be removed from the roller 130, wrapped around the dust cloth panel 110, and attached to the second pair of cloth retainers 120 in a manner similar to the dust cloth attachment described with respect to the first embodiment. With such a mechanism, the dust cloths 128 would preferably be provided as perforated sheets to be torn from the roll 130 and discarded after use, leaving a new sheet to be unrolled and attached as described above. Alternatively, a second take-up roller (not shown) can be mounted at a suitable location on or in the base assembly 14 for taking up the used cloths as new sheets are brought into position for use.

Figure 18:
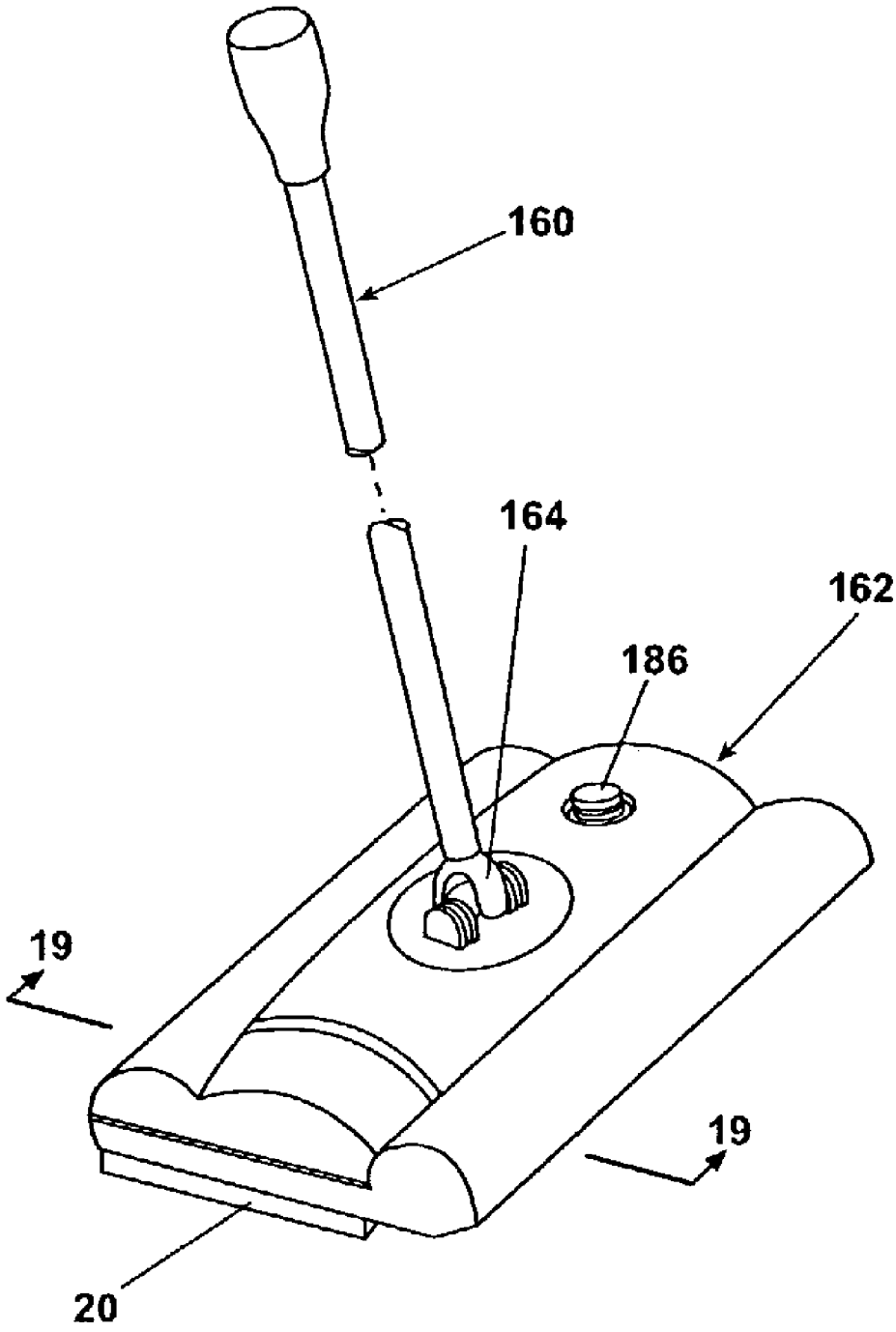
FIG. 18 is a perspective view of another embodiment of the invention that is embodied in a powered sweeper with dusting pad.
Figure 19:
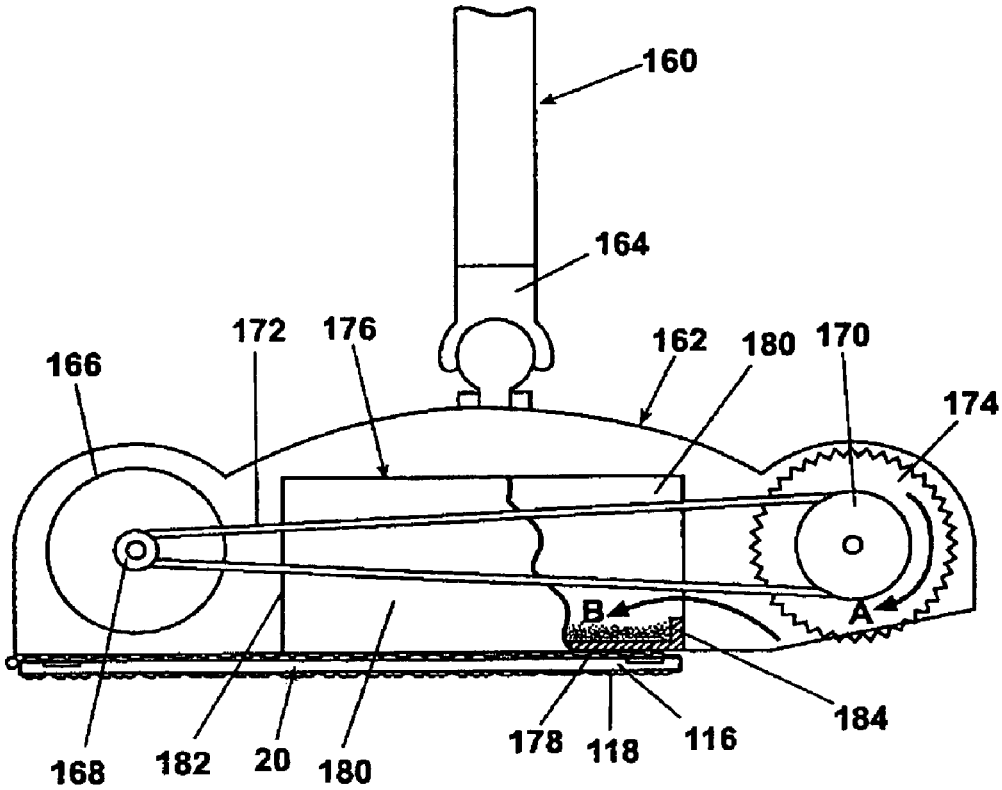
FIG. 19 is a partial cross-sectional side view of the powered sweeper illustrated in FIG. 18.

Referring to FIGS. 18 and 19, an upright handle 160 is rotatably mounted to a base 162 through a universal joint 164. A conventional electric brush motor 166 is located within an enclosure at the rear of the base 162 and further comprises a motor pinion gear 168. The motor pinion gear 168 is connected to a brush pulley 170 via a drive belt 172. The brush pulley 170 is fixedly attached to a roller brush 174. A dust collection bin 176 comprising a floor 178, a pair of parallel spaced side walls 180, a back wall 182, and a forward lip 184, is removably mounted in a central region of the base 162 and is in fluid communication with the roller brush. A conventional electrical switch 186 is electrically located between the battery pack and the brush motor 166.

In operation, the user opens the switch 186 for current to flow from the battery pack to the brush motor 166, which drives the belt 172 and thus the roller brush 174 to rotate in a clockwise direction as shown by arrow A. As the roller brush 174 rotates, larger debris is picked up by the brush and thrown upward and rearward within a cavity formed within the base 162. As indicated by arrow B, thrown debris travels over the top of the forward lip 184 and comes to rest on the floor 178 of the collection bin 176. As the sweeper unit is moved across the floor in the direction of arrow C, the dusting cloth 118 moves over the surface vacated by the roller brush 174 and picks up the smaller dust and debris left behind.

While the invention has been specifically described in connection with certain specific embodiments thereof, it is to be understood that this is by way of illustration and not of limitation. For example, the invention is applicable with or without a vacuum for the sweeper. Whereas the invention has been described with respect to a vacuum sweeper, the invention also includes a mechanical sweeper with a dusting pad mounted thereto. Further, the invention has been described with respect to a vacuum sweeper in which a brush is rotatably driven by a vacuum motor. It is within the scope of the invention to drive the brush rotation with a separate motor or with a mechanical drive connected to the wheels of the base. Further, the invention has been described with respect to a dust cloth panel that is hinged to a base assembly. It is within the scope of the invention to mount the dust cloth panel to the base assembly with other means, for example, through snap fit fasteners or hook and loop fasteners with which the dust cloth panel can be removed completely from the base assembly in order to change the dust cloth. Reasonable variation and modification are possible within the scope of the forgoing disclosure and drawing without departing from the spirit of the invention which is defined by the appended claims.

What is claimed is:

1. A vacuum cleaner comprising an upright handle pivotally mounted to a base assembly, the base assembly is adapted to move along a surface to be cleaned and comprising:

a nozzle opening extending across a portion of an underside of the base assembly for removing debris particles from the surface to be cleaned;

a dirt receptacle in the base assembly in communication with the nozzle opening for receiving the debris particles removed from the surface to be cleaned;

a motor-driven vacuum fan assembly in the base assembly in fluid communication with the nozzle opening and the dirt receptacle for moving the debris particles from the nozzle opening into the dirt receptacle;

a dust cloth mounted to the underside of the base assembly in spaced relationship to the nozzle opening and positioned for contacting the surface to be cleaned for removing dust from the surface simultaneously with the removal of debris particles from the surface through the nozzle opening; and wherein the dust cloth is attached to a roll of said dust cloths mounted to the base assembly and the wherein the roll of dust cloths at least partially removably retains the dust cloth on the base assembly.

2. A vacuum cleaner comprising an upright handle pivotally mounted to a base assembly, the base assembly is adapted to move along a surface to be cleaned and comprising:

a nozzle opening extending across a portion of an underside of the base assembly for removing debris particles from the surface to be cleaned;

a dirt receptacle in the base assembly in communication with the nozzle opening for receiving the debris particles removed from die surface to be cleaned;

a motor-driven vacuum fan assembly in the base assembly in fluid communication with the nozzle opening and the dirt receptacle for moving the debris particles from the nozzle opening into the dirt receptacle;

a dust cloth mounted to the underside of the base assembly in spaced relationship to the nozzle opening and positioned for contacting the surface to be cleaned for removing dust from the surface simultaneously with the removal of debris particles from the surface through the nozzle opening; and at least one cloth retainer mounted to an upper portion of the base assembly for removably retaining a portion of the dust cloth on the base assembly.

3. A vacuum cleaner comprising an upright handle pivotally mounted to a base assembly, the base assembly is adapted to move along a surface to be cleaned and comprising:

a nozzle opening extending across a portion of an underside of the base assembly for removing debris particles from the surface to be cleaned;

a dirt receptacle in the base assembly in communication with the nozzle opening for receiving the debris particles removed from the surface to be cleaned;

a motor-driven vacuum fan assembly in the base assembly in fluid communication with the nozzle opening and the dirt receptacle for moving the debris particles from the nozzle opening into the dirt receptacle;

a dust cloth mounted to the underside of the base assembly in spaced relationship to the nozzle opening and positioned for contacting the surface to be cleaned for removing dust from the surface simultaneously with the removal of debris particles from the surface through the nozzle opening; and wherein the dirt receptacle and the motor-driven fan assembly are connected by an air duct and the handle is mounted for rotation about the air duct.

4. The vacuum cleaner according to claim 3 wherein the handle is mounted for rotation between a forward position and a rearward position for operation of the cleaner from a forward direction or a rearward direction with respect to the base assembly.

5. A vacuum cleaner comprising an upright handle pivotally mounted to a base assembly, the base assembly is adapted to move alone a surface to be cleaned and comprising:

a nozzle opening extending across a portion of an underside of the base assembly for removing debris particles from the surface to be cleaned;

a dirt receptacle in the base assembly in communication with the nozzle opening for receiving the debris particles removed from the surface to be cleaned;

a motor-driven vacuum fan assembly in the base assembly in fluid communication with the nozzle opening and the dirt receptacle for moving the debris particles from the nozzle opening into the dirt receptacle;

a dust cloth mounted to the underside of the base assembly in spaced relationship to the nozzle opening and positioned for contacting the surface to be cleaned for removing dust from the surface simultaneously with the removal of debris particles from die surface through the nozzle opening; and a motor-driven brush assembly the base assembly for rotation in the nozzle opening.

6. The vacuum cleaner according to claim 5 wherein the brush assembly is driven about a horizontal axis.

7. A floor cleaner comprising an upright handle pivotally mounted to a base assembly, the base assembly is adapted to move along a surface to be cleaned and comprising:

a nozzle opening in an underside of the base assembly and a rotary driven brush assembly mounted for rotation in the nozzle opening for removing debris particles from the surface;

a dirt receptacle in communication with the nozzle opening for receiving the debris particles removed from the surface;

a dust cloth for removing dust from the surface to be cleaned and mounted to the underside of the base assembly for removing dust from the surface; and a dust cloth panel hingedly mounted to the base assembly and mounting the dust cloth for selectively pivoting the dust cloth panel between a first, opened position away from the underside of the base assembly for removal and mounting of the dust cloth to the dust cloth panel and a second, closed position in operative position for contacting the surface to be cleaned.

8. The floor cleaner according to claim 7 and further comprising at least one first cloth retainer mounted to an upper surface of the dust cloth panel for retaining a first portion of the dust cloth.

9. The floor cleaner according to claim 8 and further comprising at least one second cloth retainer mounted to an upper portion of the base assembly for retaining a second portion of the dust cloth, whereby the dust cloth is positioned over a second, lower panel surface to remove dust from the surface as the base assembly is maneuvered over the surface.

10. The floor cleaner according to claim 9 and further comprising a pad attached to a lower surface of the dust cloth panel for supporting the dust cloth against the surface to be cleaned.

11. The floor cleaner according to claim 10 wherein the pad is a resilient pad.

12. The floor cleaner according to claim 9 wherein there are at least two second cloth retainers.

13. The floor cleaner according to claim 8 wherein there are at least two first cloth retainers.

14. A floor cleaner comprising an upright handle pivotally mounted to a base assembly, the base assembly is adapted to move along a surface to be cleaned and comprising:

a nozzle opening in an underside of the base assembly and a rotary driven brush assembly mounted for rotation in the nozzle opening for removing debris i,articles from the surface to be cleaned;

a dirt receptacle in communication with the nozzle opening for receiving debris particles removed from the surface to be cleaned;

a dust cloth for removing duet from the surface to be cleaned and mounted to the underside of the base assembly for removing dust from the surface; and wherein the dust cloth is attached to a roll of said dust cloths mounted to the base assembly and the wherein the roll of dust cloths at least partially removably retains the dust cloth on the base assembly.

15. A floor cleaner comprising an upright handle pivotally mounted to a base assembly, the base assembly is adapted to move along a surface to be cleaned and comprising:

a nozzle opening in an underside of the base assembly and a rotary driven brush assembly mounted for rotation in the nozzle opening for removing debris particles from the surface;

a dirt receptacle in communication with the nozzle opening for receiving the debris particles removed from the surface;

a dust cloth for removing dust from the surface to be cleaned and mounted to the underside of the base assembly for removing dust from the surface; and at least one cloth retainer mounted to an upper portion of the base assembly for removably retaining a portion of the dust cloth on the base assembly.

16. The floor cleaner according to claim 15 and further comprising a motor-driven vacuum fan assembly in fluid communication with the dirt receptacle for moving the debris particles from the brush assembly into the dirt receptacle.

17. The floor cleaner according to claim 16 and further comprising a battery pack removably mounted to the base assembly and connected to a motor for the vacuum fan assembly to supply electric power thereto.

18. A vacuum cleaner comprising an upright handle pivotally mounted to a base assembly, the base assembly is adapted to move along a surface to be cleaned and comprising:

a nozzle opening extending across a portion of an underside of the base assembly for removing debris particles from the surface to be cleaned;

a dirt receptacle in the base assembly in communication with the nozzle opening for receiving the debris particles removed from the surface to be cleaned;

a motor-driven vacuum fan assembly in the base assembly in fluid communication with the nozzle opening and the dirt receptacle for moving the debris particles from the nozzle opening into the dirt receptacle;

a dust cloth mounted to the underside of the base assembly in spaced relationship to the nozzle opening and positioned for contacting the surface to be cleaned for removing dust from the surface simultaneously with the removal of debris particles from the surface through the nozzle opening; and a dust cloth panel removably mounting the dust cloth and mounted in the base assembly for movement away from the underside of the base assembly for service of the dust cloth.

19. The vacuum cleaner according to claim 18 and further comprising at least one first cloth retainer mounted to an upper surface of the dust cloth panel for retaining a first portion of the dust cloth.

20. The vacuum cleaner according to claim 19 and further comprising at least one second cloth retainer mounted to an upper portion of the base assembly for retaining a second portion of the dust cloth, whereby the dust cloth is positioned over a second, lower panel surface to remove dust from the surface as the base assembly is maneuvered over the surface.

21. The vacuum cleaner according to claim 20 and further comprising a pad attached to a lower surface of the dust cloth panel for supporting the dust cloth against the surface to be cleaned.

22. The vacuum cleaner according to claim 21 wherein the pad is a resilient pad.

23. The vacuum cleaner according to claim 20 wherein there are at least two second cloth retainers.

24. The vacuum cleaner according to claim 19 wherein there are at least two first cloth retainers.

25. The vacuum cleaner according to claim 18 and further comprising a pad attached to a lower surface of the dust cloth panel for supporting the dust cloth against the surface to be cleaned.

26. The vacuum cleaner according to claim 18 and further comprising a battery pack removably mounted to the base assembly and connected to a motor for the vacuum fan assembly to supply electric power thereto.

27. The vacuum cleaner according to claim 18 wherein the dust cloth panel is removably mounted in the base assembly.

28. The vacuum cleaner according to claim 18 wherein the dust cloth panel is hinged in the base assembly at one side thereof for selectively pivoting the dust cloth panel between a first, opened position away from the underside of the base assembly for removal and mounting of the dust cloth to the dust cloth panel and a second, closed position in operative position for contacting the surface to be cleaned.

29. A floor cleaner comprising an upright handle pivotally mounted to a base assembly, the base assembly is adapted to move along a surface to be cleaned and comprising:

a nozzle opening in the underside of the base assembly and a rotary driven brush assembly mounted for rotation in the nozzle opening for removing debris particles from the surface;

a dirt receptacle in the base assembly in communication with the nozzle opening for receiving the debris particles removed from the surface;

a dust cloth for removing dust from the surface to be cleaned and mounted in the base assembly at the underside thereof for removing dust from the surface; and a dust cloth panel removably mounting the dust cloth and mounted to the base assembly for movement away from the base assembly for service of the dust cloth.

30. The floor cleaner according to claim 29 wherein the dust cloth panel is removably mounted to the base assembly.

31. The floor cleaner according to claim 29 and further comprising a pad attached to a lower surface of the dust cloth panel for supporting the dust cloth against the surface to be cleaned.

32. The floor cleaner according to claim 29 wherein the nozzle opening is at a front portion of the base assembly and the dust cloth is mounted to a rear portion of the base assembly.

33. The floor cleaner according to claim 29 wherein the nozzle opening is positioned at one end of the base assembly and the dust cloth panel is positioned at a second end of the base assembly, and the handle is mounted to the base assembly for rotation between a forward position overlying the nozzle opening and a rearward position overlying the dust cloth panel for operation of the sweeper from a forward position or rearward position with respect to the sweeper base assembly.

34. A floor cleaner comprising an upright handle pivotally mounted to a base assembly, the base assembly is adapted to move along a surface to be cleaned and comprising:

a nozzle opening in an underside of the base assembly;

a dirt receptacle in communication with the nozzle opening for receiving the debris particles removed from the surface;

a vacuum source connected to the nozzle opening and the dirt receptacle for removing debris particles and depositing them in the dirt receptacle;

a dust cloth for removing dust from the surface to be cleaned and mounted to the underside of the base assembly for removing dust from the surface; and at least one cloth retainer mounted to an upper portion of the base assembly for removably retaining a portion of the dust cloth on the base assembly.

35. The floor cleaner according to claim 34 wherein the base assembly comprises a dust cloth panel that removably mounts the dust cloth and the cloth retainer is formed in the dust cloth panel.

36. A vacuum cleaner comprising an upright handle pivotally mounted to a base assembly, the base assembly is adapted to move along a surface to be cleaned and comprising:

a nozzle opening extending across a portion of an underside of a front portion of the base assembly for removing debris particles from the surface to be cleaned;

a dirt receptacle mounted in the base assembly in communication with the nozzle opening for receiving the debris particles removed from the surface;

a motor-driven vacuum fan assembly in the base assembly in fluid communication with the nozzle opening and the dirt receptacle for moving the debris particles from the nozzle opening into the dirt receptacle; and a dust cloth mounted to the underside of the base assembly at a rear portion thereof and positioned only rearwardly of the nozzle opening for contacting the surface to be cleaned for removing dust from the surface simultaneously with the removal of debris particles from the surface through the nozzle opening.

37. The vacuum cleaner according to claim 36 wherein the handle is mounted to the base assembly for rotation between a forward position overlying the nozzle opening and a rearward position overlying the dust cloth for operation of the floor cleaner from a forward position or rearward position with respect to the base assembly.

* * * * *

UNITED STATES PATENT AND TRADEMARK OFFICE

CERTIFICATE OF CORRECTION

PATENT NO. : 7,013,528 B2
APPLICATION NO. : 10/248101
DATED : March 21, 2006
INVENTOR(S) : Timothy S. Parker, David L. Haan and David E. McDowell It is certified that error appears in the above-identified patent and that said Letters Patent is hereby corrected as shown below:

Column 9,
Line 67, reads "...removed from die surface to be cleaned;" it should read -- ...removed from the surface to be cleaned; --.

Column 10,
Line 45, reads "adapted to move alone a surface to be cleaned…" it should read -- adapted to move along a surface to be cleaned... --.
Line 62, reads "removal of debris particles from die surface..." it should read -- removal of debris particles from the surface... --.
Line 64, reads "motor-driven brush assembly the base assembly..." it should read -- motor-driven brush assembly in the base assembly… --.

Column 11,
Line 48, reads "...for removing debris i,articles from" it should read -- ...for removing debris particles from --.
Line 53, reads "...for removing duet from the surface…" it should read -- ...for removing dust from the surface… --.

Signed and Sealed this

Eleventh Day of July, 2006

JON W. DUDAS
*Director of the United States Patent and Trademark Office*